US012376622B2

(12) United States Patent
Lee et al.

(10) Patent No.: US 12,376,622 B2
(45) Date of Patent: Aug. 5, 2025

(54) AEROSOL-GENERATING DEVICE

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 415 days.

(21) Appl. No.: 17/907,934

(22) PCT Filed: Feb. 7, 2022

(86) PCT No.: PCT/KR2022/001794
§ 371 (c)(1),
(2) Date: Aug. 29, 2022

(87) PCT Pub. No.: WO2022/169315
PCT Pub. Date: Aug. 11, 2022

(65) Prior Publication Data

US 2023/0329339 A1 Oct. 19, 2023

(30) Foreign Application Priority Data

Feb. 8, 2021 (KR) ..... 10-2021-0017686

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/44* (2020.01); *A24F 40/465* (2020.01); *A24F 40/51* (2020.01);
(Continued)

(58) Field of Classification Search
CPC ..... A24F 40/10; A24F 40/20
See application file for complete search history.

(56) References Cited

U.S. PATENT DOCUMENTS 9,814,263 B2 11/2017 Cochand et al.
2016/0157523 A1 6/2016 Liu
(Continued)

FOREIGN PATENT DOCUMENTS

KR 10-2019-0022597 3/2019
KR 20190049389 A * 5/2019 ..... A24F 47/00
(Continued)

OTHER PUBLICATIONS

Jang et al. WO2019151687A1 English Machine Translation (Year: 2019).*
(Continued)

*Primary Examiner* — Michael H. Wilson
*Assistant Examiner* — Daniel Edward Vakili
(74) *Attorney, Agent, or Firm* — LEE, HONG, DEGERMAN, KANG & WAIMEY

(57) ABSTRACT

An aerosol-generating device is disclosed. The aerosol-generating device of the present disclosure includes a cartridge, which includes an inner wall defining an insertion space into which a stick is inserted and a chamber formed between the inner wall and an outer wall to store an aerosol-generating substance, a wick, which is disposed adjacent to one end of the insertion space, which is elongated so as to be connected to the chamber, and which has formed therein a hollow portion, a heater, which is configured to heat the wick, and a probe member, which is elongated such that at least a portion thereof is disposed in the insertion space. When the stick is inserted into the insertion space, the at least the portion of the probe member is inserted into the stick.

11 Claims, 10 Drawing Sheets

(51) Int. Cl.

| | |
|---|---|
| ***A24F 40/44*** | (2020.01) |
| ***A24F 40/465*** | (2020.01) |
| ***A24F 40/51*** | (2020.01) |
| ***A24F 40/53*** | (2020.01) |
| *A24F 40/65* | (2020.01) |

(52) U.S. Cl.
CPC ..... *A24F 40/53* (2020.01); *A24F 40/10* (2020.01); *A24F 40/65* (2020.01)

(56) References Cited

U.S. PATENT DOCUMENTS

| | | | | |
|---|---|---|---|---|
| 2018/0296777 | A1* | 10/2018 | Terry | A61M 11/042 |
| 2020/0375249 | A1 | 12/2020 | Yanez | |
| 2020/0383379 | A1 | 12/2020 | Yilmaz | |
| 2022/0256926 | A1* | 8/2022 | Illidge | A24F 40/485 |

FOREIGN PATENT DOCUMENTS

| | | | | |
|---|---|---|---|---|
| KR | 10-2019-0093027 | | 8/2019 | |
| KR | 10-2019-0126865 | | 11/2019 | |
| KR | 10-2020-0030977 | | 3/2020 | |
| RU | 2710657 | | 12/2019 | |
| RU | 2734473 | | 10/2020 | |
| WO | 2019002613 | | 1/2019 | |
| WO | WO-2019151687 | A1 * | 8/2019 | A24D 1/002 |
| WO | 2020149505 | | 7/2020 | |

OTHER PUBLICATIONS

Lim KR20190049389A English Machine Translation (Year: 2019).*
Korean Intellectual Property Office Application No. 10-2021-0017686, Notice of Allowance dated Jan. 27, 2023, 2 pages.
PCT International Application No. PCT/KR2022/001794, International Search Report dated May 23, 2022, 3 pages.

* cited by examiner

[Fig. 1]
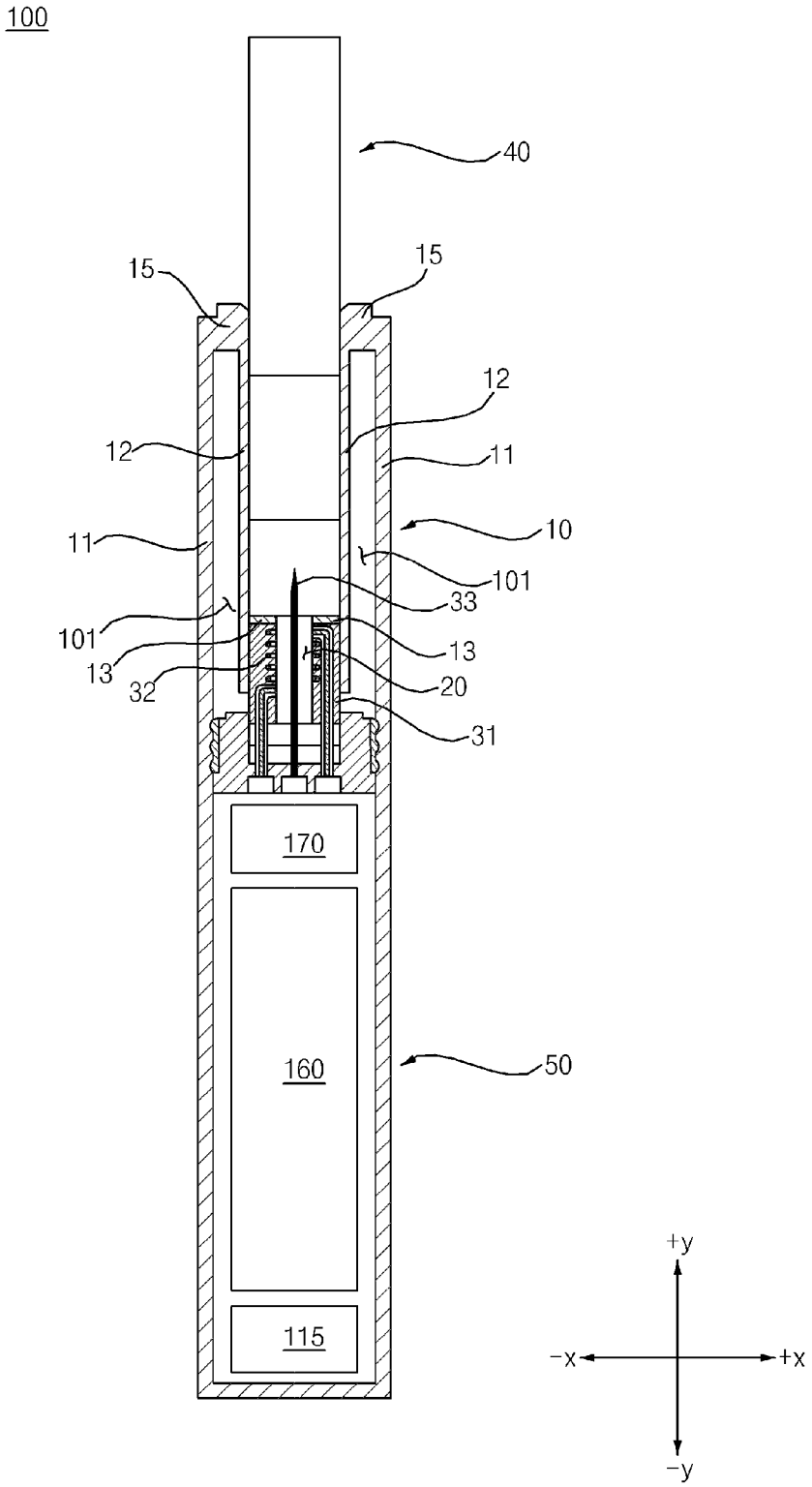

[Fig. 2]
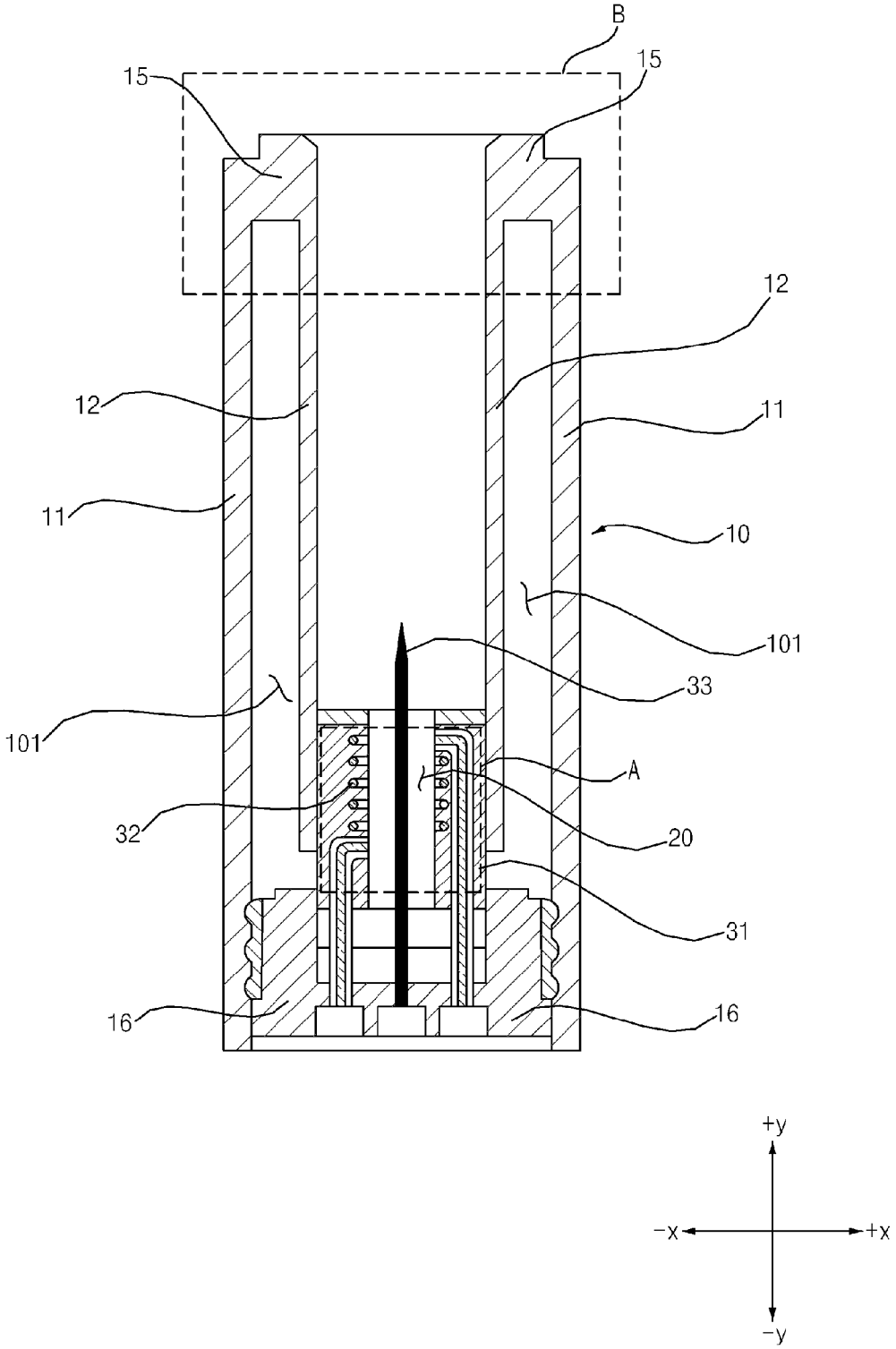

[Fig. 3A]
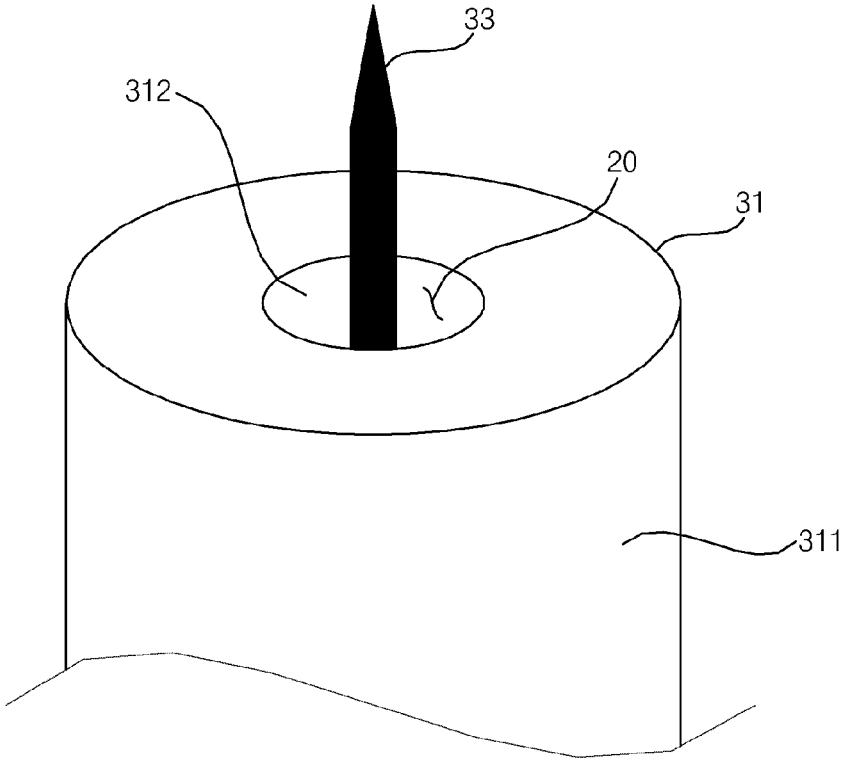

[Fig. 3B]
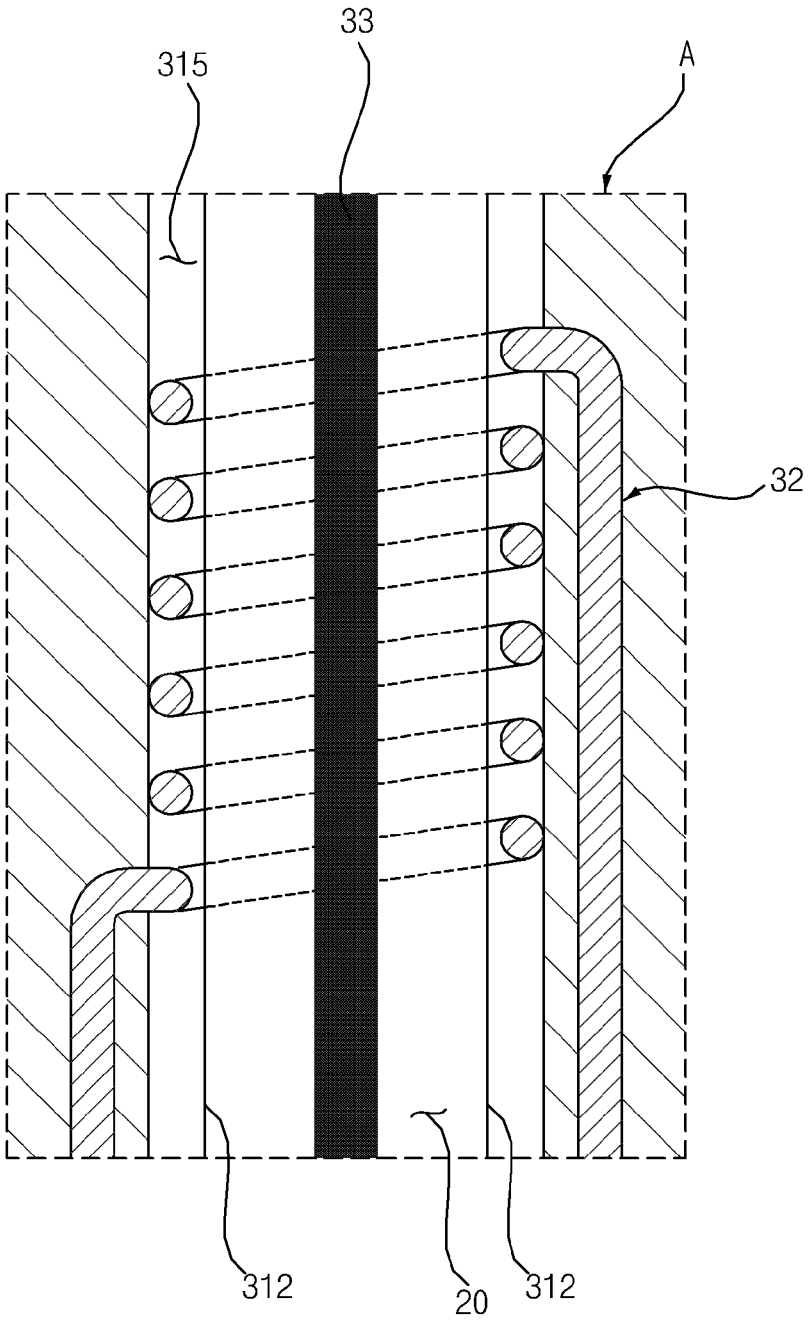

[Fig. 4A]
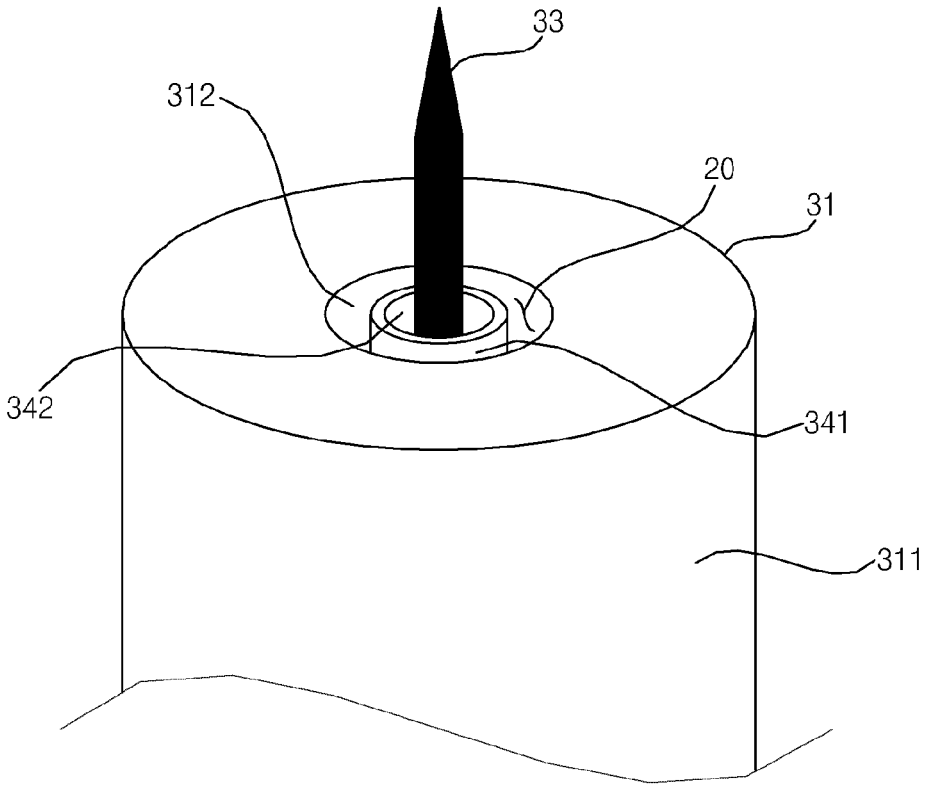

[Fig. 4B]
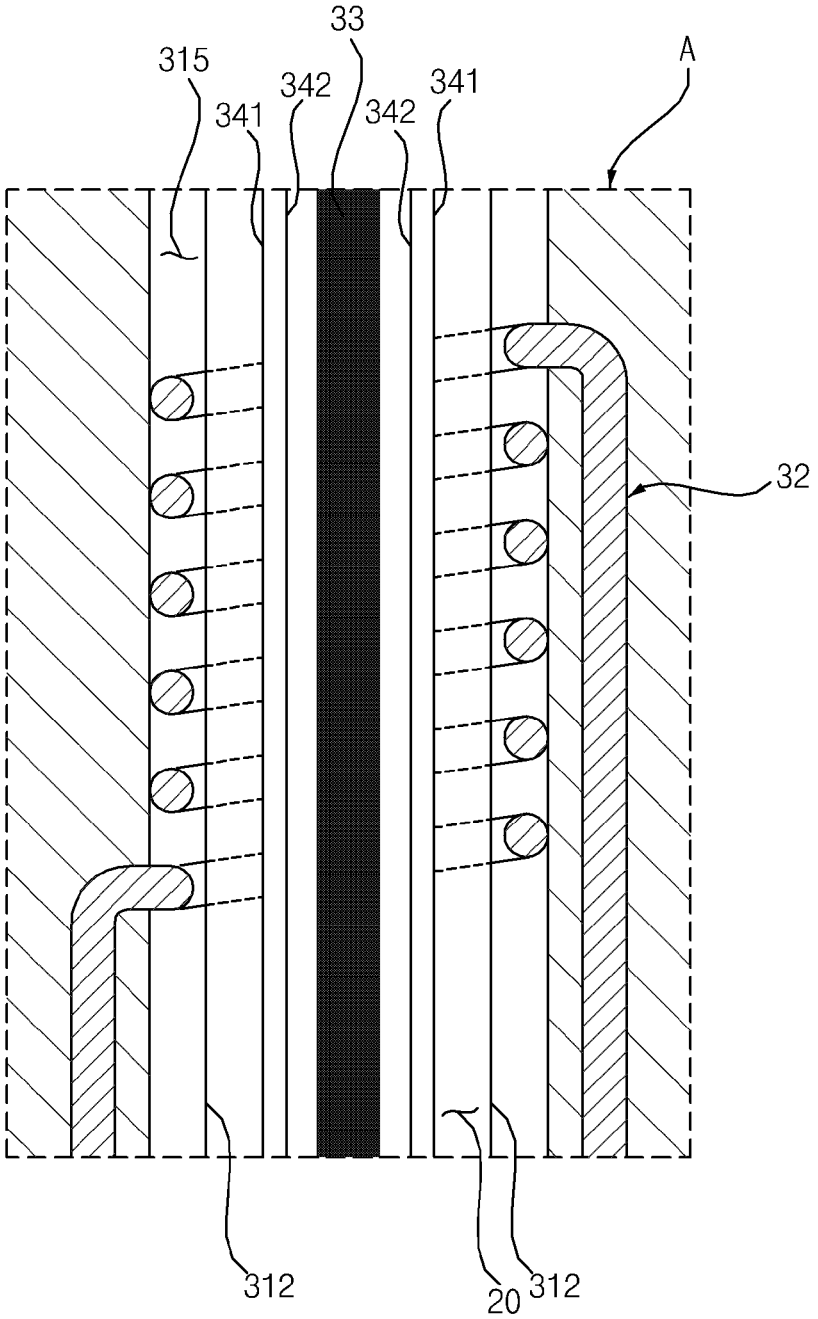

[Fig. 5]
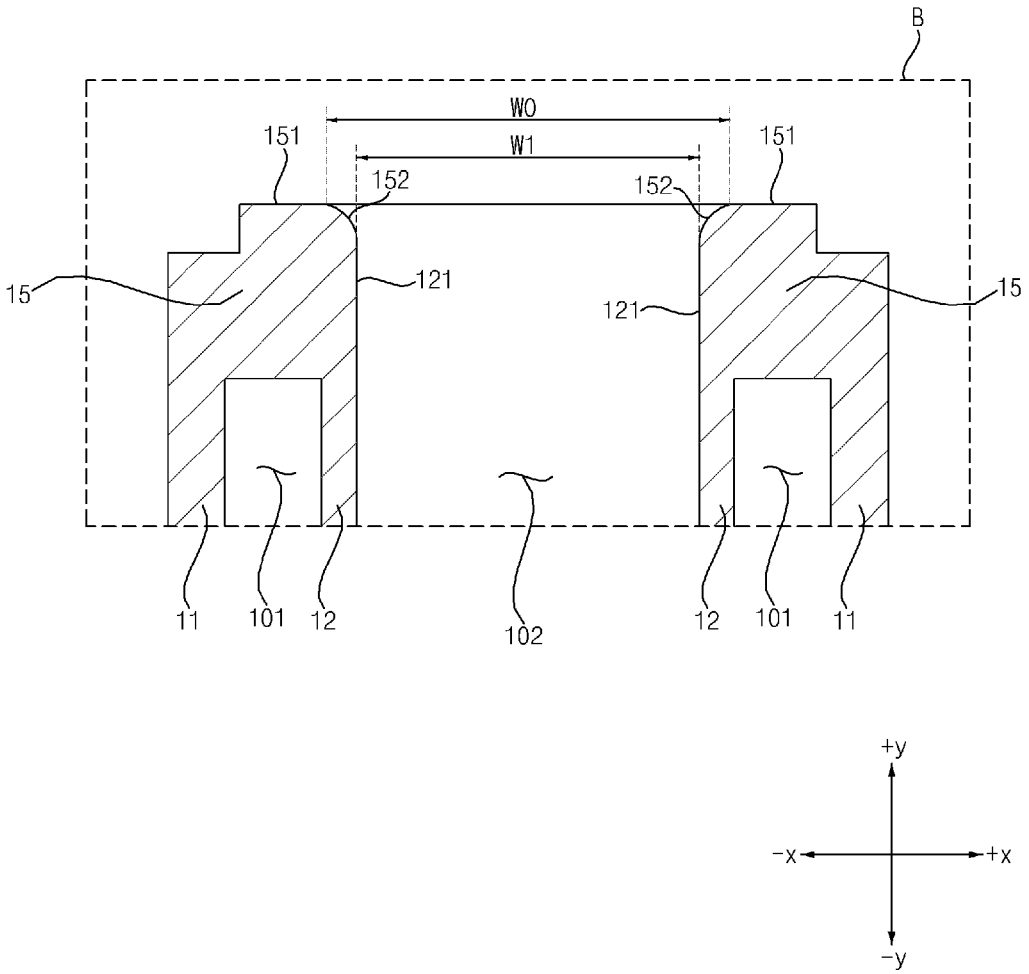

[Fig. 6]
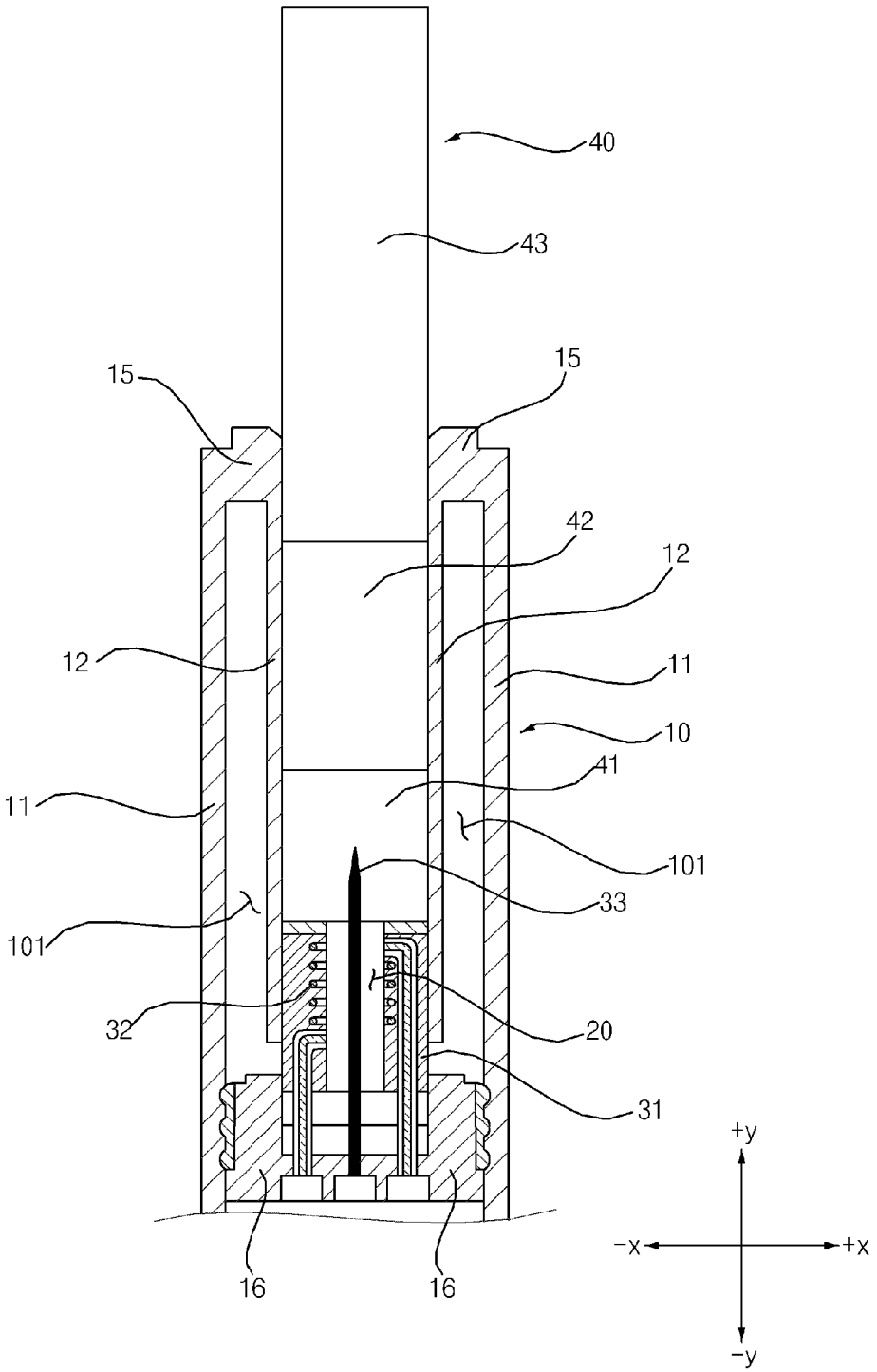

[Fig. 7]
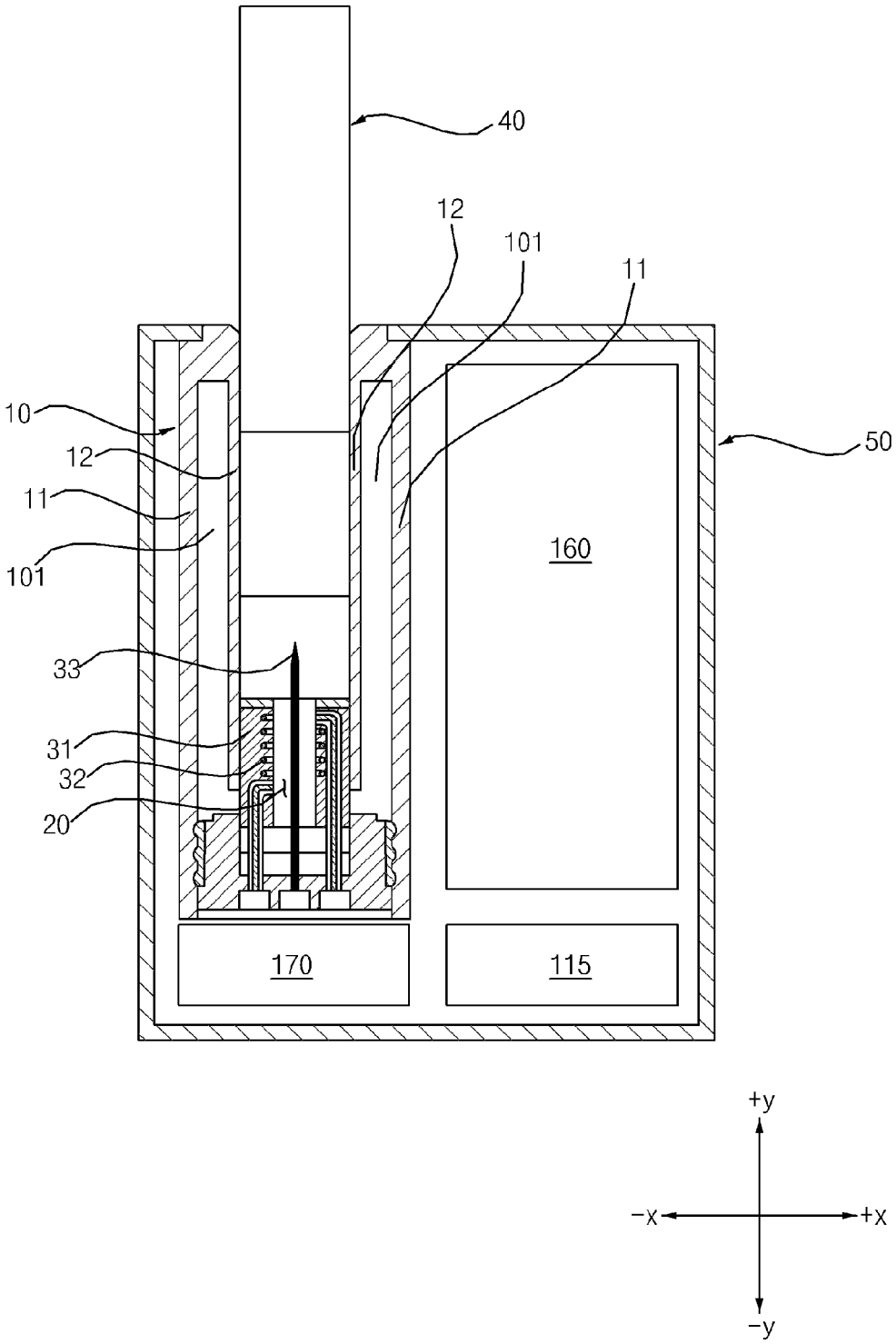

[Fig. 8]
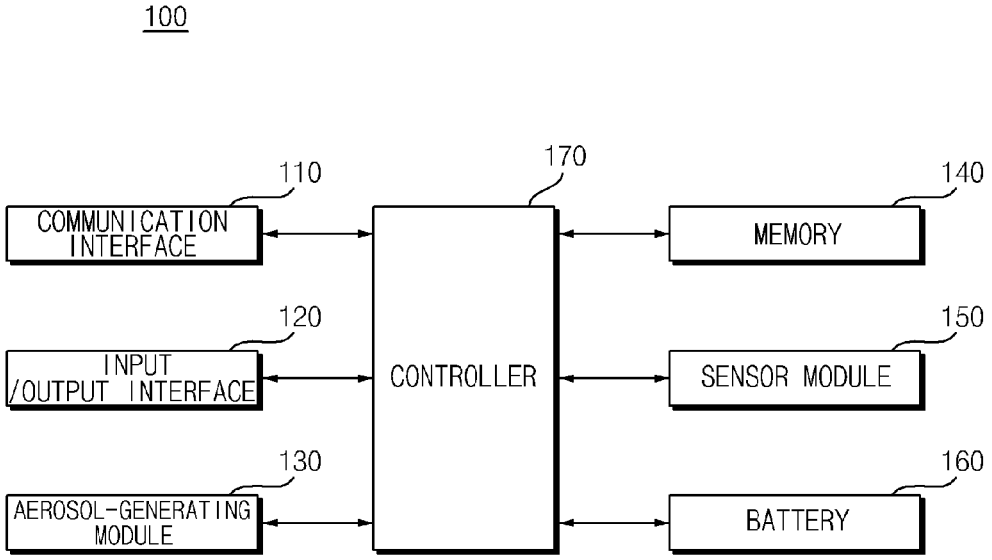
[Fig. 9]
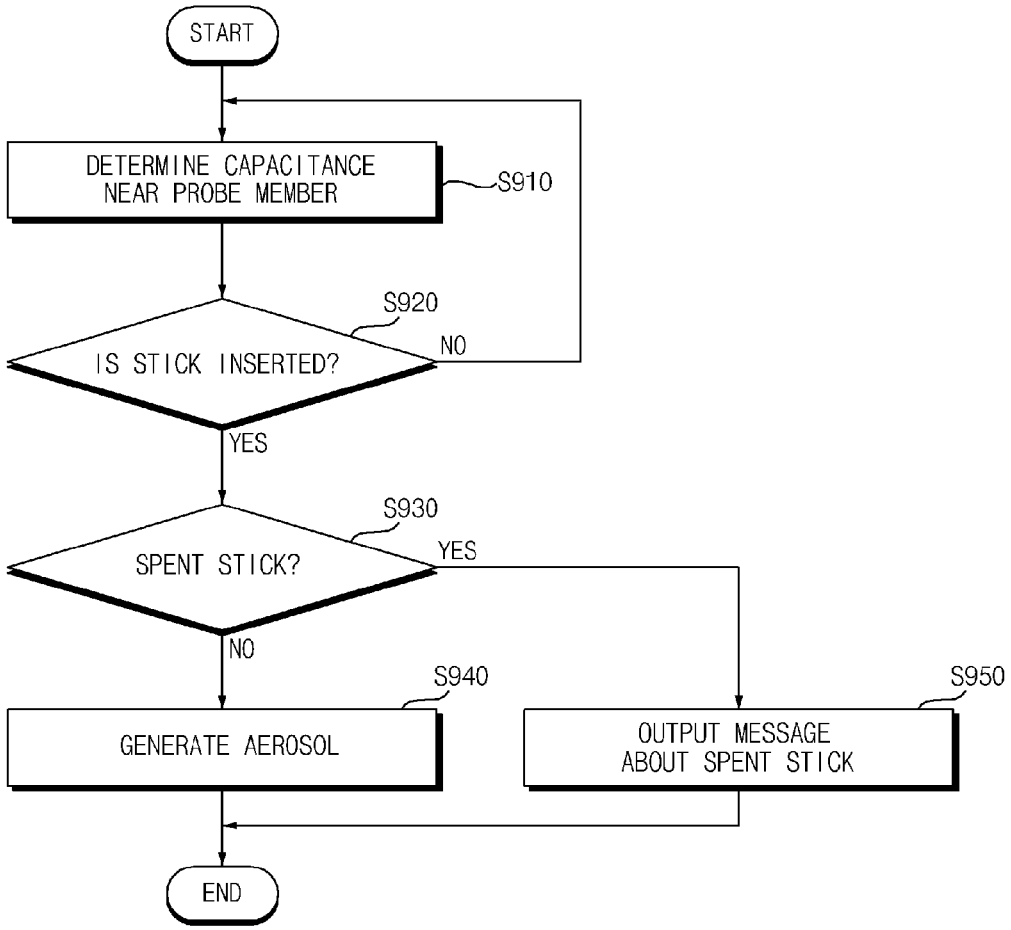

AEROSOL-GENERATING DEVICE

CROSS-REFERENCE TO RELATED APPLICATIONS

This application is the National Stage filing under 35 U.S.C. 371 of International Application No. PCT/KR2022/001794, filed on Feb. 7, 2022, which claims the benefit of earlier filing date and right of priority to Korean Application No. 10-2021-0017686, filed on Feb. 8, 2021, the contents of which are all hereby incorporated by reference herein their entirety.

TECHNICAL FIELD

The present disclosure relates to an aerosol-generating device.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted. Recently, various research on aerosol-generating devices has been conducted.

DISCLOSURE OF INVENTION

Technical Problem

It is an object of the present disclosure to solve the above and other problems.

It is another object of the present disclosure to provide an aerosol-generating device capable of accurately determining whether a stick inserted thereinto is a spent stick.

It is still another object of the present disclosure to provide an aerosol-generating device capable of reducing the distance that an aerosol moves to the stick, thereby increasing efficiency of transfer of a high-temperature aerosol to the stick without substantial heat loss.

Solution to Problem

An aerosol-generating device according to an aspect of the present disclosure for accomplishing the above and other objects may include a cartridge, which includes an inner wall defining an insertion space into which a stick is inserted and a chamber formed between the inner wall and an outer wall to store an aerosol-generating substance, a wick, which is disposed adjacent to one end of the insertion space, which is elongated so as to be connected to the chamber, and which has formed therein a hollow portion, a heater, which is configured to heat the wick, and a probe member, which is elongated such that at least a portion thereof is disposed in the insertion space. When the stick is inserted into the insertion space, the at least the portion of the probe member may be inserted into the stick.

Advantageous Effects of Invention

According to at least one of embodiments of the present disclosure, when a stick is inserted, the capacitance of the stick is detected by a probe member inserted into the stick, thus making it possible to more accurately determine whether the stick is a spent stick.

According to at least one of embodiments of the present disclosure, since the probe member, which is formed so as to be inserted into the stick, is disposed in a hollow portion in a wick, the aerosol-generating device is capable of being miniaturized and integrated.

According to at least one of embodiments of the present disclosure, since the wick, which is connected to a chamber storing an aerosol-generating substance in a liquid state, and a heater for heating the wick are disposed close to the stick, the distance that an aerosol moves to the stick is short, thus making it possible to increase efficiency of transfer of a high-temperature aerosol to the stick without substantial heat loss.

Additional applications of the present disclosure will become apparent from the following detailed description. However, because various changes and modifications will be clearly understood by those skilled in the art within the spirit and scope of the present disclosure, it should be understood that the detailed description and specific embodiments, such as preferred embodiments of the present disclosure, are merely given by way of example.

BRIEF DESCRIPTION OF DRAWINGS

The above and other objects, features, and other advantages of the present disclosure will be more clearly understood from the following detailed description taken in conjunction with the accompanying drawings, in which:

FIGS. 1 to 7 are views for explaining an aerosol-generating device according to embodiments of the present disclosure;

FIG. 8 is a block diagram of an aerosol-generating device according to an embodiment of the present disclosure; and FIG. 9 is a flowchart showing an operation method of the aerosol-generating device according to an embodiment of the present disclosure.

BEST MODE FOR CARRYING OUT THE INVENTION

Hereinafter, the embodiments disclosed in the present specification will be described in detail with reference to the accompanying drawings. The same or similar elements are denoted by the same reference numerals even though they are depicted in different drawings, and redundant descriptions thereof will be omitted.

In the following description, with respect to constituent elements used in the following description, the suffixes "module" and "unit" are used only in consideration of facilitation of description. The "module" and "unit" are do not have mutually distinguished meanings or functions.

In addition, in the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present disclosure.

It will be understood that the terms "first", "second", etc., may be used herein to describe various components. However, these components should not be limited by these terms. These terms are only used to distinguish one component from another component.

It will be understood that when a component is referred to as being "connected to" or "coupled to" another component, it may be directly connected to or coupled to another component. However, it will be understood that intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

Hereinafter, the directions of an aerosol-generating device may be defined based on the orthogonal coordinate system shown in FIGS. 1 to 7. In the orthogonal coordinate system, the x-axis direction may be defined as the leftward-rightward direction of the aerosol-generating device. Here, based on the origin, the +x-axis direction may be the rightward direction, and the −x-axis direction may be the leftward direction. The y-axis direction may be defined as the upward-downward direction of the aerosol-generating device. Here, based on the origin, the +y-axis direction may be the upward direction, and the −y-axis direction may be the downward direction. The z-axis direction may be defined as the forward-backward direction of the aerosol-generating device. Here, based on the origin, the +z-axis direction may be the forward direction, and the −z-axis direction may be the backward direction.

Referring to FIGS. 1 and 2, a cartridge 10 may have a shape that extends in the upward-downward direction. The cartridge 10 may have a hollow shape. The cartridge 10 may have the shape of a cylinder that extends in the upward-downward direction.

The cartridge 10 may include an outer wall 11 and an inner wall 12. The outer wall 11 may extend in the upward-downward direction. The outer wall 11 may extend along the outer periphery of the cartridge 10. The outer wall 11 may extend in the circumferential direction to form a cylindrical shape. The cartridge 10 may be elongated. The longitudinal direction of the cartridge 10 may be the direction in which the cartridge 10 is elongated. The longitudinal direction of the cartridge 10 may be the upward-downward direction.

The inner wall 12 may extend in the upward-downward direction. The inner wall 12 may extend along the inner periphery of the cartridge 10. The inner wall 12 may extend in the circumferential direction to form a cylindrical shape.

The inner wall 12 may be spaced inwards apart from the outer wall 11. The inner wall 12 may be spaced apart from the outer wall 11 in the radially inward direction. The outer wall 11 and the inner wall 12 may be connected to each other via the upper portion 15 of the cartridge 10.

The inner wall 12 may extend both in the upward-downward direction and in the circumferential direction to form an insertion space 102 therein. The insertion space 102 may be formed such that the interior of the inner wall 12 is open in the upward-downward direction. A stick 40 may be inserted into the insertion space 102. The inner wall 12 may be disposed between a chamber 101 and the insertion space 102.

A bottom 13 may be formed so as to protrude from a portion of the inner wall 12 in the inward direction of the cartridge 10. The bottom 13 may be formed so as to extend in the circumferential direction.

The insertion space 102 may have a shape corresponding to the shape of the portion of the stick 40 that is inserted thereinto. The insertion space 102 may be elongated in the upward-downward direction. The insertion space 102 may have a cylindrical shape. When the stick 40 is inserted into the insertion space 102, the stick 40 may be surrounded by the inner wall 12 and the bottom 13, and may be in close contact with the inner wall 12 and the bottom 13.

The chamber 101 may be formed between the outer wall 11 and the inner wall 12. The chamber 101 may extend in the upward-downward direction. The chamber 101 may extend in the circumferential direction along the outer wall 11 and the inner wall 12. The chamber 101 may have a cylindrical shape. An aerosol-generating substance may be stored in the chamber 101. The aerosol-generating substance may be liquid.

The chamber 101 may be defined by the outer wall 11, the inner wall 12, the upper portion 15, and the lower portion 16 of the cartridge 10.

A flow path 20 may be formed in the lower portion of the inner wall 12. The suctioned air may pass through the flow path 20.

A wick 31 may be connected to the chamber 101. The wick 31 may absorb the aerosol-generating substance stored in the chamber 101.

The wick 31 may be disposed below the insertion space 102. The wick 31 may be inserted into the space between the bottom 13 and the lower portion 16 of the cartridge 10. The wick 31 may be formed so as to extend in the upward-downward direction. The wick 31 may extend in the circumferential direction along the inner wall 12. The wick 31 may have a cylindrical shape.

The wick 31 may be made of ceramic. The wick 31 may be porous. The wick 31 may be made of porous ceramic.

The wick 31 may have therein a hollow portion. The hollow portion may penetrate the wick 31 in the longitudinal direction of the wick 31. The hollow portion may be disposed at the center of the wick 31. The hollow portion may communicate with the insertion space 102. The hollow portion may be included in the flow path 20.

The heater 32 may heat the aerosol-generating substance. The heater 32 may evaporate the aerosol-generating substance. The heater 32 may heat the aerosol-generating substance absorbed in the wick 31. For example, the heater 32 may heat the wick 31 using an electrical resistance heating method to evaporate the aerosol-generating substance absorbed in the wick 31, thereby generating an aerosol.

The heater 32 may be inserted into the wick 31. For example, the heater 32 may be inserted into the wick 31 in the form of being wound in the direction in which the wick 31 extends. The heater 32 may have the shape of a spiral that surrounds the hollow portion of the wick 31.

A probe member 33 may extend in the upward-downward direction. The probe member 33 may be formed in the shape of a needle that has a long cylindrical-shaped body with a conical-shaped tip formed at one end of the body, but the shape of the probe member 33 is not limited thereto.

The probe member 33 may be disposed so as to penetrate the wick 31. The probe member 33 may be disposed in the hollow portion of the wick 31.

When the stick 40 is inserted into the insertion space 102, at least a portion of the probe member 33 may be inserted into the stick 40. For example, the portion of the probe member 33 that protrudes from the surface corresponding to the bottom 13 toward the insertion space 102 may be inserted into the stick 40.

The probe member 33 may include a conductive material. The probe member 33 may include at least one electrode made of a conductive material. At least a portion of the probe member 33 may be made of a metal material having high conductivity, such as gold (Au), silver (Ag), copper (Cu), or aluminum (Al). For example, the conductive material of the portion of the probe member 33 that protrudes from the surface corresponding to the bottom 13 toward the insertion space 102 may be exposed to the outside. For example, the remaining portion of the probe member 33, other than the portion thereof that protrudes from the surface corresponding to the bottom 13 toward the insertion space 102, may be coated with an insulator in order to prevent the conductive material from being exposed to the outside.

The stick 40 may be elongated in the upward-downward direction. The stick 40 may have a cylindrical shape. The stick 40 may be inserted into the insertion space 102 formed in the cartridge 10. The stick 40 may be brought into close contact with the inner wall 12 and the bottom 13 of the cartridge 10.

The aerosol generated from the wick 31 may flow toward the insertion space 102 through the flow path 20. When the stick 40 is inserted into the insertion space 102, the aerosol generated from the wick 31 may be transferred to the stick 40 through the flow path 20, and the aerosol transferred to the stick 40 may pass through the stick 40. The direction in which the aerosol flows may be the upward direction.

A main body 50 may have a shape that extends in the upward-downward direction. The main body 50 may have a hollow shape. The main body 50 may have the shape of a cylinder that extends in the upward-downward direction.

The cartridge 10 and the main body 50 may be connected to each other. The cartridge 10 may be disposed on the main body 50. The cartridge 10 may be detachably coupled to the main body 50. The cartridge 10 and the main body 50 may form a continuous surface.

A controller 170 may be disposed inside the main body 50. The controller 170 may control the on/off operation of the device. The controller 170 may control the supply of power to the heater 32 so that the heater 32 heats the wick 31.

The controller 170 may be disposed below the heater 32. The controller 170 may be disposed adjacent to the heater 32.

The controller 170 may perform control such that a predetermined amount of current flows through the probe member 33. The controller 170 may calculate a capacitance of an object contacting the probe member 33. In this case, the result of calculating the capacitance may vary depending on the state of the object contacting the probe member 33. For example, as the amount of moisture contained in the object contacting the probe member 33 increases, the capacitance may also increase.

A battery 160 may be disposed inside the main body 50. The battery 160 may supply power to the device. The battery 160 may be electrically connected to the controller 170 and/or a terminal 115. The battery 160 may be disposed below the controller 170. The battery 160 may extend in the upward-downward direction.

The terminal 115 may be disposed in the bottom portion of the main body 50. The terminal 115 may be electrically connected to an external power source to receive power therefrom, and may transmit the power to the battery 160. The terminal 115 may be disposed below the battery 160.

Referring to FIGS. 3A and 3B, the wick 31 may have a hollow cylindrical shape. The wick 31 may be made of porous ceramic.

The hollow portion 20 in the wick 31 may be formed by being surrounded by an inner surface 312 of the wick 31. The inner surface 312 of the wick 31 may extend in the upward-downward direction.

The probe member 33 may be disposed in the hollow portion 20 in the wick 31 so as to penetrate the wick 31. The probe member 33 may be disposed so as to be spaced apart by a predetermined distance from the inner surface 312 of the wick 31.

The heater 32 may be located between the outer surface 311 and the inner surface 312 of the wick 31. The heater 32 may be disposed adjacent to the inner surface 312 of the wick 31. The heater 32 may be disposed in an inner region 315 in the wick 31, which extends both in the upward-downward direction and in the circumferential direction and is located adjacent to the inner surface 312 of the wick 31.

The heater 32 may have the shape of a spiral that surrounds the hollow portion 20 in the wick 31. The heater 32 may extend in a spiral shape, and may extend in the longitudinal direction of the wick 31.

The heater 32 may be disposed adjacent to the outlet in the flow path 20. The heater 32 may be disposed closer to the upper end of the wick 31, which is adjacent to the insertion space 102, than to the lower end of the wick 31, which is in contact with the chamber 101. Accordingly, the aerosol may flow into the insertion space 102 at a high temperature.

The heater 32 may be evenly disposed from the upper end portion to the lower end portion of the wick 31 in the flow path 20. Accordingly, the area of the wick 31 that is heated by the heater 32 may increase, and thus the amount of aerosol that is generated may increase.

Referring to FIGS. 4A and 4B, an isolation member 34 may be further disposed in the hollow portion 20 in the wick 31. The isolation member 34 may have a hollow cylindrical shape.

The isolation member 34 may extend in the upward-downward direction. The length that the isolation member 34 extends in the upward-downward direction may be equal to or longer than the length that the wick 31 extends in the upward-downward direction.

The diameter of the isolation member 34, defined by the outer surface 341 thereof, may be smaller than the diameter of the wick 31, defined by the inner surface 312 thereof.

The aerosol generated by the heater 32 may flow through the space surrounded by the inner surface 312 of the wick 31 and the outer surface 341 of the isolation member 34.

The probe member 33 may be disposed in the space defined by the inner surface 342 of the isolation member 34 so as to penetrate the wick 31. The probe member 33 may be disposed so as to be spaced apart by a predetermined distance from the inner surface 342 of the isolation member 34.

Referring to FIG. 5, the upper portion 15 of the cartridge 10 may be formed at the upper sides of the outer wall 11 and the inner wall 12, and may interconnect the outer wall 11 and the inner wall 12. The upper portion 15 of the cartridge 10 may cover the upper side of the chamber 101. The upper portion 15 of the cartridge 10 may extend in the circumferential direction to surround the insertion space 102.

The inner surface 121 of the cartridge 10 may form the inner side surfaces of the inner wall 12 and the upper portion 15. The inner surface 121 of the cartridge 10 may extend in the upward-downward direction.

An inclined surface 152 may be formed between the upper surface 151 and the inner surface 121 of the cartridge 10 to interconnect the upper surface 151 and the inner surface 121. The inclined surface 152 may be formed in a gently curved shape between the upper surface 151 and the inner surface 121 of the cartridge 10. The inclined surface 152 may extend from the inner surface 121 to the upper surface 151 so as to gradually spread in the radially outward direction. Since the inclined surface 152 is inclined in the outward direction, the inclined surface 152 may be gradually narrowed in the downward direction. The inner surface 121, the upper surface 151, and the inclined surface 152 may form a continuous surface.

The width W1 defined by the lower end of the inclined surface 152 may be smaller than the width W0 defined by the upper end of the inclined surface 152. The width W1 defined by the lower end of the inclined surface 152 and the width defined by the inner surface 121 may be substantially equal to each other. Accordingly, the stick 40 may be easily inserted into the insertion space 102.

Referring to FIG. 6, a plug 41 may be disposed in the lower portion of the stick 40. A filter 43 may be disposed in the upper portion of the stick 40. A granulation unit 42 may be disposed between the plug 41 and the filter 43 inside the stick 40. A medium may be included in the granulation unit 42.

A user may inhale air in the state of holding the filter 43 of the stick 40, inserted into the cartridge 10, in the mouth. When the user inhales air through the stick 40, the aerosol generated from the wick 31 may pass through the flow path 20, and may then flow into the granulation unit 42 via the plug 41. The aerosol introduced into the granulation unit 42 may be introduced into the filter 43 together with the constituents of the medium, and may then be provided to the user after being filtered.

Although the probe member 33 is illustrated in the drawings as being inserted into the plug 41 of the stick 40, the present disclosure is not limited thereto. For example, when the stick 40 is inserted into the insertion space 102, the probe member 33 may be inserted into the granulation unit 42 through the plug 41.

Referring to FIG. 7, the main body 50 may extend in the leftward-rightward direction. The cartridge 10 may be coupled to the left or right side of the main body 50. The cartridge 10 may be disposed inside the main body 50, and may be coupled to the main body 50.

The controller 170 may be disposed inside the main body 50. The controller 170 may be disposed below the heater 32. The controller 170 may be disposed adjacent to the heater 32.

The battery 160 may be disposed inside the main body 50. The battery 160 may be disposed beside the cartridge 10. The battery 160 may extend in the upward-downward direction along the cartridge 10.

The terminal 115 may be disposed inside the main body 50. The terminal 115 may be disposed adjacent to the controller 170 and the battery 160.

FIG. 8 is a block diagram of an aerosol-generating device according to an embodiment of the present disclosure.

Referring to FIG. 1, an aerosol-generating device 100 may include a communication interface 110, an input/output interface 120, an aerosol-generating module 130, a memory 140, a sensor module 150, a battery 160, and/or a controller 170.

In one embodiment, the aerosol-generating device 100 may be composed of a cartridge 10, which contains an aerosol-generating substance, and a main body 50. In this case, the components included in the aerosol-generating device 100 may be located in at least one of the main body 50 or the cartridge 10.

The communication interface 110 may include at least one communication module for communication with an external device and/or a network. For example, the communication interface 110 may include a communication module for wired communication, such as a Universal Serial Bus (USB). For example, the communication interface 110 may include a communication module for wireless communication, such as Wireless Fidelity (Wi-Fi), Bluetooth, Bluetooth Low Energy (BLE), ZigBee, or nearfield communication (NFC).

The input/output interface 120 may include an input device (not shown) for receiving a command from a user and/or an output device (not shown) for outputting information to the user. For example, the input device may include a touch panel, a physical button, a microphone, or the like. For example, the output device may include a display device for outputting visual information, such as a display or a light-emitting diode (LED), an audio device for outputting auditory information, such as a speaker or a buzzer, a motor for outputting tactile information such as haptic effect, or the like.

The input/output interface 120 may transmit data corresponding to a command input by the user through the input device to another component (or other components) of the aerosol-generating device 100. The input/output interface 120 may output information corresponding to data received from another component (or other components) of the aerosol-generating device 100 through the output device.

The aerosol-generating module 130 may generate an aerosol from an aerosol-generating substance. Here, the aerosol-generating substance may be a substance in a liquid state, a solid state, or a gel state, which is capable of generating an aerosol, or a combination of two or more aerosol-generating substances.

According to an embodiment, the liquid aerosol-generating substance may be a liquid including a tobacco-containing material having a volatile tobacco flavor component. According to another embodiment, the liquid aerosol-generating substance may be a liquid including a non-tobacco material. For example, the liquid aerosol-generating substance may include water, solvents, nicotine, plant extracts, flavorings, flavoring agents, vitamin mixtures, etc.

The solid aerosol-generating substance may include a solid material based on a tobacco raw material such as a reconstituted tobacco sheet, shredded tobacco, or granulated tobacco. In addition, the solid aerosol-generating substance may include a solid material having a taste control agent and a flavoring material. For example, the taste control agent may include calcium carbonate, sodium bicarbonate, calcium oxide, etc. For example, the flavoring material may include a natural material such as herbal granules, or may include a material such as silica, zeolite, or dextrin, which includes an aroma ingredient.

In addition, the aerosol-generating substance may further include an aerosol-forming agent such as glycerin or propylene glycol.

The aerosol-generating module 130 may include at least one heater.

The aerosol-generating module 130 may include an electro-resistive heater. For example, the electro-resistive heater may include at least one electrically conductive track. The electro-resistive heater may be heated as current flows through the electrically conductive track. At this time, the aerosol-generating substance may be heated by the heated electro-resistive heater.

The electrically conductive track may include an electro-resistive material. In one example, the electrically conductive track may be formed of a metal material. In another example, the electrically conductive track may be formed of a ceramic material, carbon, a metal alloy, or a composite of a ceramic material and metal.

The electro-resistive heater may include an electrically conductive track that is formed in any of various shapes. For example, the electrically conductive track may be formed in a coil shape.

The aerosol-generating module 130 may include a heater that uses an induction-heating method. For example, the induction heater may include an electrically conductive coil. The induction heater may generate an alternating magnetic field, which periodically changes in direction, by adjusting the current flowing through the electrically conductive coil. At this time, when the alternating magnetic field is applied to a magnetic body, energy loss may occur in the magnetic body due to eddy current loss and hysteresis loss. In addition, the lost energy may be released as thermal energy. Accordingly, the aerosol-generating substance located adjacent to the magnetic body may be heated. Here, an object that generates heat due to the magnetic field may be referred to as a susceptor.

Meanwhile, the aerosol-generating module 130 may generate ultrasonic vibrations to thereby generate an aerosol from the aerosol-generating substance.

The aerosol-generating device 100 may be referred to as a cartomizer, an atomizer, or a vaporizer.

The memory 140 may store programs for processing and controlling each signal in the controller 170, and may store processed data and data to be processed.

For example, the memory 140 may store applications designed for the purpose of performing various tasks that can be processed by the controller 170. The memory 140 may selectively provide some of the stored applications in response to the request from the controller 170.

For example, the memory 140 may store data on the operation time of the aerosol-generating device 100, the maximum number of puffs, the current number of puffs, the number of uses of battery 160, at least one temperature profile, and data about charging/discharging. Here, "puff" means inhalation by the user. "inhalation" means the user's act of taking air or other substances into the user's oral cavity, nasal cavity, or lungs through the user's mouth or nose.

The memory 140 may include at least one of volatile memory (e.g. dynamic random access memory (DRAM), static random access memory (SRAM), or synchronous dynamic random access memory (SDRAM)), nonvolatile memory (e.g. flash memory), a hard disk drive (HDD), or a solid-state drive (SSD).

The sensor module 150 may include at least one sensor.

For example, the sensor module 150 may include a sensor for sensing a puff (hereinafter referred to as a "puff sensor"). In this case, the puff sensor may be implemented as a pressure sensor, a gyro sensor, an acceleration sensor, a magnetic field sensor, or the like.

For example, the sensor module 150 may include a sensor for sensing the temperature of the heater included in the aerosol-generating module 130 and the temperature of the aerosol-generating substance (hereinafter referred to as a "temperature sensor"). In this case, the heater included in the aerosol-generating module 130 may also serve as the temperature sensor. For example, the electro-resistive material of the heater may be a material having a predetermined temperature coefficient of resistance. The sensor module 150 may measure the resistance of the heater, which varies according to the temperature, to thereby sense the temperature of the heater.

For example, in the case in which the aerosol-generating device 100 includes a cartridge 10, the sensor module 150 may include a sensor for sensing mounting and demounting of the cartridge 10 to and from the main body 50 and the position of the cartridge 10 (hereinafter referred to as a "cartridge detection sensor").

The cartridge detection sensor may be implemented as an inductance-based sensor, a capacitive sensor, a resistance sensor, or a Hall sensor (or Hall IC) using a Hall effect.

For example, the sensor module 150 may include a voltage sensor for sensing voltage applied to a component (e.g. the battery 160) provided in the aerosol-generating device 100 and/or a current sensor for sensing current.

The battery 160 may supply electric power used for operation of the aerosol-generating device 100 under the control of the controller 170. The battery 160 may supply electric power to other components provided in the aerosol-generating device 100, for example, the communication module included in the communication interface 1010, the output device included in the input/output interface 120, and the heater included in the aerosol-generating module 130.

The battery 160 may be a rechargeable battery or a disposable battery. For example, the battery 160 may be a lithium-ion battery or a lithium polymer (Li-polymer) battery. However, the present disclosure is not limited thereto. For example, when the battery 160 is rechargeable, the charging rate (C-rate) of the battery 160 may be 10C, and the discharging rate (C-rate) thereof may be 10C to 20C. However, the present disclosure is not limited thereto. Also, for stable use, the battery 160 may be manufactured such that 80% or more of the total capacity may be ensured even when charging/discharging is performed 2000 times.

The aerosol-generating device 100 may further include a battery protection circuit module (PCM), which is a circuit for protecting the battery 160. The battery protection circuit module (PCM) may be disposed adjacent to the upper surface of the battery 160. For example, in order to prevent overcharging and overdischarging of the battery 160, the battery protection circuit module (PCM) may cut off the electrical path to the battery 160 when a short circuit occurs in a circuit connected to the battery 160, when an overvoltage is applied to the battery 160, or when an overcurrent flows through the battery 160.

The aerosol-generating device 100 may further include a charging terminal (e.g., the terminal 115 of FIG. 1) to which power supplied from the outside is input. For example, a charging terminal may be disposed at one side of the main body 50 of the aerosol-generating device 100, and the aerosol generating device 100 may charge the battery 160 using power supplied through the charging terminal.

For example, a power line may be connected to the charging terminal, which is disposed at one side of the main body 50 of the aerosol-generating device 100, and the aerosol-generating device 100 may use the electric power supplied through the power line connected to the charging terminal to charge the battery 160. In this case, the charging terminal may be configured as a wired terminal for USB communication, a pogo pin, or the like.

The aerosol-generating device 100 may wirelessly receive electric power supplied from the outside through the communication interface 1010. For example, the aerosol-generating device 100 may wirelessly receive electric power using an antenna included in the communication module for wireless communication, and may charge the battery 160 using the wirelessly supplied electric power.

The controller 170 may control the overall operation of the aerosol-generating device 100. The controller 170 may be connected to each of the components provided in the aerosol-generating device 100, and may transmit and/or receive a signal to and/or from each of the components, thereby controlling the overall operation of each of the components.

The controller 170 may include at least one processor, and may control the overall operation of the aerosol-generating device 100 using a processor included therein. Here, the processor may be a general processor such as a central processing unit (CPU). Of course, the processor may be a dedicated device such as an application-specific integrated circuit (ASIC), or may be any of other hardware-based processors.

The controller 170 may perform any one of a plurality of functions of the aerosol-generating device 100. For example, the controller 170 may perform any one of a plurality of functions of the aerosol-generating device 100 (e.g. a preheating function, a heating function, a charging function, and a cleaning function) according to the state of each of the components provided in the aerosol-generating device 100 and the user's command received through the input/output interface 120.

The controller 170 may control the operation of each of the components provided in the aerosol-generating device 100 based on data stored in the memory 140. For example, the controller 170 may control the supply of a predetermined amount of electric power from the battery 160 to the aerosol-generating module 130 based on data on the temperature profile stored in the memory 140.

The controller 170 may determine the occurrence or non-occurrence of a puff using the puff sensor included in the sensor module 150. For example, the controller 170 may check a temperature change, a flow change, a pressure change, and a voltage change in the aerosol-generating device 100 based on the values sensed by the puff sensor, and may determine the occurrence or non-occurrence of a puff based on the result of checking.

The controller 170 may control the operation of each of the components provided in the aerosol-generating device 100 according to the occurrence or non-occurrence of a puff and/or the number of puffs.

Upon determining that a puff has occurred, the controller 170 may perform control such that a predetermined amount of electric power is supplied from the battery 160 to the aerosol-generating module 130.

The controller 170 may control power to be supplied to the heater using at least one of a pulse width modulation (PWM) method and a proportional-integral-differential (PID) method.

For example, the controller 170 may perform control such that a current pulse having a predetermined frequency and a predetermined duty ratio is supplied to the heater using a pulse width modulation (PWM) method. In this case, the controller 170 may control the amount of electric power supplied to the heater by adjusting the frequency and the duty ratio of the current pulse.

For example, the controller 170 may determine a target temperature to be controlled based on the temperature profile. In this case, the controller 170 may control the amount of electric power supplied to the heater using a proportional-integral-differential (PID) method, which is a feedback control method using a difference value between the temperature of the heater and the target temperature, a value obtained by integrating the difference value with respect to time, and a value obtained by differentiating the difference value with respect to time.

Although the PWM method and the PID method are described as examples of a method of controlling the supply of electric power to the heater, the present disclosure is not limited thereto, and may employ any of various control methods, such as a proportional-integral (PI) method or a proportional-differential (PD) method.

The controller 170 may perform control such that the supply of electric power to the heater is interrupted according to a predetermined condition. For example, the controller 170 may perform control such that the supply of electric power to the aerosol-generating module 130 is interrupted when a cigarette is removed, when the cartridge 10 is demounted, when the number of puffs reaches a preset maximum number of puffs, when a puff is not sensed during a preset period of time or longer, or when the remaining capacity of the battery 160 is less than a predetermined value.

The controller 170 may calculate the remaining capacity with respect to the electric power stored in the battery 160. For example, the controller 170 may calculate the remaining capacity of the battery 160 based on the values sensed by the voltage sensor and/or the current sensor included in the sensor module 150.

FIG. 9 is a flowchart of an operation method of the aerosol-generating device according to another embodiment of the present disclosure.

Referring to FIG. 9, the aerosol-generating device 100 may determine the capacitance near the probe member 33 using the probe member 33 included in the cartridge 10 in operation S910. For example, the aerosol-generating device 100 may perform control such that a predetermined amount of current flows through the probe member 33, and may monitor the capacitance near the probe member 33, which is exposed to the insertion space 102.

The aerosol-generating device 100 may determine whether the stick 40 is inserted into the insertion space 102 based on the capacitance near the probe member 33 in operation S920. For example, when the capacitance near the probe member 33 exceeds a predetermined first reference value, the aerosol-generating device 100 may determine that the stick 40 has been inserted into the insertion space 102.

Here, the first reference value may be a capacitance value corresponding to the state in which the probe member 33 is exposed to the air in the insertion space 102. That is, when the probe member 33 comes into contact with the interior of the stick 40, the capacitance near the probe member 33 may be increased by the dielectric constant of the interior of the stick 40 compared to the case in which the probe member 33 is exposed to air.

Upon determining that the stick 40 has been inserted into the insertion space 102, the aerosol-generating device 100 may determine whether the inserted stick 40 is a spent stick in operation S930. For example, when the capacitance near the probe member 33 exceeds a second reference value, which is greater than the first reference value, the aerosol-generating device 100 may determine that the stick 40 inserted into the insertion space 102 is a spent stick.

Here, the second reference value may be a capacitance value corresponding to the state in which the interior of the stick 40 is dry. Because the aerosol generated by heating by the heater 32 passes through the stick 40 and is then provided to a user, a spent stick may contain moisture and glycerin in a liquid state. The capacitance near the probe member 33 may be increased by the moisture and glycerin present in the spent stick in a liquid state compared to the case in which the interior of the stick 40 is dry.

When the stick 40 inserted into the insertion space 102 is not a spent stick, the aerosol-generating device 100 may perform an operation related to aerosol generation in operation S940. For example, the aerosol-generating device 100 may adjust the intensity of the power that is supplied from the battery 160 to the heater 32 based on the temperature profile stored in the memory 140. For example, the aerosol-generating device 100 may adjust the intensity of the power that is supplied from the battery 160 to the heater 32 depending on whether a puff is sensed by the puff sensor included in the sensor module 150.

When a spent stick is inserted into the insertion space 102, the aerosol-generating device 100 may output a message about the spent stick through an output interface in operation S950. For example, the aerosol-generating device 100 may output a message about the spent stick using a display device such as, for example, a light-emitting diode.

Also, when a spent stick is inserted into the insertion space 102, the aerosol-generating device 100 may interrupt the supply of power to the heater 32.

As described above, according to at least one of the embodiments of the present disclosure, when the stick 40 is inserted, the capacitance of the stick 40 is detected by the probe member 33 inserted into the stick 40, thus making it possible to more accurately determine whether the stick 40 is a spent stick.

According to at least one of the embodiments of the present disclosure, since the probe member 33, which is formed so as to be inserted into the stick 40, is disposed in the hollow portion of the wick 31, the aerosol-generating device 100 is capable of being miniaturized and integrated.

According to at least one of the embodiments of the present disclosure, since the wick 31, which is connected to the chamber 101 storing an aerosol-generating substance in a liquid state, and the heater 32 for heating the wick 31 are disposed close to the stick 40, the distance that an aerosol moves to the stick is short, thus making it possible to increase efficiency of transfer of the high-temperature aerosol to the stick without substantial heat loss.

Referring to FIGS. 1 to 9, an aerosol-generating device 100 in accordance with one aspect of the present disclosure may include a cartridge 10, which includes an inner wall 12 defining an insertion space 102 into which a stick 40 is inserted and a chamber 101 formed between the inner wall 12 and an outer wall 11 to store an aerosol-generating substance, a wick 31, which is disposed adjacent to one end of the insertion space 102, which is elongated so as to be connected to the chamber 101, and which has formed therein a hollow portion, a heater 32, which is configured to heat the wick 31, and a probe member 33, which is elongated such that at least a portion of the probe member is disposed in the insertion space 102. When the stick 40 is inserted into the insertion space 102, at least a portion of the probe member 33 may be inserted into the stick 40.

In addition, in accordance with another aspect of the present disclosure, the wick 31 may have a hollow cylindrical shape.

In addition, in accordance with another aspect of the present disclosure, the probe member 33 may be disposed in the hollow portion of the wick 31.

In addition, in accordance with another aspect of the present disclosure, the probe member 33 may be spaced apart by a predetermined distance from the inner surface of the hollow portion of the wick 31.

In addition, in accordance with another aspect of the present disclosure, the aerosol-generating device may further include an isolation member 34, which is disposed in the hollow portion of the wick 31, which is elongated, and which has formed therein a hollow portion. The diameter defined by the outer surface 341 of the isolation member 34 may be smaller than the diameter defined by the inner surface 312 of the wick 31. The probe member 33 may be disposed in the hollow portion in the isolation member 34.

In addition, in accordance with another aspect of the present disclosure, the wick 31 may include porous ceramic.

In addition, in accordance with another aspect of the present disclosure, the heater 32 may be inserted into the space between the inner surface 312 and the outer surface 311 of the wick 31.

In addition, in accordance with another aspect of the present disclosure, the heater 32 may include a coil having the shape of a spiral that surrounds the hollow portion and extends in the longitudinal direction of the wick 31.

In addition, in accordance with another aspect of the present disclosure, the aerosol-generating device may further include a controller 170, and the controller 170 may detect a capacitance near the probe member 33 based on a current flowing through the probe member 33, and may determine the state of the stick 40 based on the detected capacitance.

In addition, in accordance with another aspect of the present disclosure, when the detected capacitance exceeds a predetermined first reference value, the controller 170 may determine that the stick 40 has been inserted into the insertion space 102. When the detected capacitance exceeds a second reference value, which is greater than the first reference value, the controller 170 may determine that the stick 40 inserted into the insertion space 102 is a spent stick.

In addition, in accordance with another aspect of the present disclosure, upon determining that the stick 40 inserted into the insertion space 102 is a spent stick, the controller 170 may perform control to interrupt the supply of power to the heater 32.

Certain embodiments or other embodiments of the disclosure described above are not mutually exclusive or distinct from each other. Any or all elements of the embodiments of the disclosure described above may be combined with another or combined with each other in configuration or function).

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An aerosol-generating device comprising:

a cartridge including an inner wall and an outer wall, wherein the inner wall defines an insertion space configured to accommodate insertion of a stick, and wherein a chamber configured to store an aerosol-generating substance is defined between the inner wall and the outer wall;

a wick comprising a hollow portion and disposed at an end of the insertion space;

a heater configured to heat the wick; and an elongated probe member positioned such that at least a portion of the probe member protrudes into the insertion space, wherein the at least the portion of the probe member is configured to be inserted into the stick when the stick is inserted into the insertion space, and wherein the probe member is disposed in the hollow portion of the wick.

2. The aerosol-generating device according to claim 1, wherein an end of the probe member has a pointed tip.

3. The aerosol-generating device according to claim 1, wherein the wick has a hollow cylindrical shape.

4. The aerosol-generating device according to claim 1, wherein the probe member is spaced apart from an inner surface of the hollow portion of the wick.

5. The aerosol-generating device according to claim 1, further comprising:

an elongated isolation member disposed in the hollow portion in the wick, wherein the isolation member comprises a hollow portion, wherein a diameter defined by an outer surface of the isolation member is smaller than a diameter defined by an inner surface of the hollow portion of the wick, and wherein the probe member is disposed in the hollow portion in the isolation member.

6. The aerosol-generating device according to claim 1, wherein the wick includes porous ceramic.

7. The aerosol-generating device according to claim 1, wherein the heater is disposed between an inner surface of the hollow portion of the wick and an outer surface of the wick.

8. The aerosol-generating device according to claim 1, wherein the heater includes a coil having a shape of a spiral that surrounds the hollow portion of the wick and extends in a longitudinal direction of the wick.

9. An aerosol-generating device comprising:

a cartridge including an inner wall and an outer wall, wherein the inner wall defines an insertion space configured to accommodate insertion of a stick, and wherein a chamber configured to store an aerosol-generating substance is defined between the inner wall and the outer wall;

a wick comprising a hollow portion and disposed at an end of the insertion space;

a heater configured to heat the wick;

an elongated probe member positioned such that at least a portion of the probe member protrudes into the insertion space; and a controller configured to determine a state of the stick based on a capacitance detected near the probe member based on a current flowing through the probe member, wherein the at least the portion of the probe member is configured to be inserted into the stick when the stick is inserted into the insertion space.

10. The aerosol-generating device according to claim 9, wherein the controller is configured to:

determine that the stick has been inserted into the insertion space based on the detected capacitance exceeding a first reference value; and determine that the stick inserted into the insertion space is spent based on the detected capacitance exceeding a second reference value greater than the first reference value.

11. The aerosol-generating device according to claim 9, wherein the controller is configured to perform control to interrupt supply of power to the heater based on a determination that the stick is spent.

* * * * *